US006648491B2

(12) United States Patent
Tokida et al.

(10) Patent No.: US 6,648,491 B2
(45) Date of Patent: Nov. 18, 2003

(54) VEHICLE LAMP USING LIGHT EMITTING DIODE

(75) Inventors: Tsukasa Tokida, Shizuoka (JP); Tsutomu Machida, Shizuoka (JP); Tadayuki Okuda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/058,009

(22) Filed: Jan. 29, 2002

(65) Prior Publication Data

US 2002/0101734 A1 Aug. 1, 2002

(30) Foreign Application Priority Data

Jan. 29, 2001 (JP) ..... P2001-019439
Jan. 29, 2001 (JP) ..... P2001-019440

(51) Int. Cl.[7] ..... F21V 5/04
(52) U.S. Cl. ..... 362/245; 362/328; 362/800
(58) Field of Search ..... 362/237, 240, 362/241, 243, 245, 247, 299, 300, 255, 256, 327, 328, 335, 800; 313/512

(56) References Cited

U.S. PATENT DOCUMENTS 4,698,730 A * 10/1987 Sakai et al. ..... 362/800
4,862,330 A 8/1989 Machida et al.
5,068,771 A * 11/1991 Savage, Jr. ..... 362/255
6,038,387 A 3/2000 Machida
6,328,456 B1 * 12/2001 Mize ..... 362/327

FOREIGN PATENT DOCUMENTS

| | | |
|---|---|---|
| DE | 31 37 685 C3 | 4/1983 |
| GB | 2 288 658 | 10/1995 |
| JP | 63-133684 A | 6/1988 |
| JP | 9-223822 A | 8/1997 |

* cited by examiner

*Primary Examiner*—Y. My Quach-Lee
(74) *Attorney, Agent, or Firm*—Sughrue Mion, PLLC

(57) ABSTRACT

In a light emitting diode 1 having a light emitting chip 2 and a lens portion 3 for containing the chip 2, the lens portion 3 has a direct light area 5 for use in emitting the light emitted from the chip 2 outside as direct light and a reflected light area 6 for use in emitting the light emitted from the chip 2 and passed through the lens portion 3 toward a reflective member 7 provided outside the lens portion 3, in which the direct light area 5 is formed so as to have a configuration irrotationally symmetric around the optical axis of an element, and the peripheral portion of the direct light area 5 or the side portion of the lens portion 3 is used as the reflected light area 6, which is formed so as to have a configuration rotationally symmetric around the optical axis of the element.

3 Claims, 9 Drawing Sheets

VEHICLE LAMP USING LIGHT EMITTING DIODE

BACKGROUND OF THE INVENTION

1. Field of the Invention

The present invention relates to a vehicle lamp utilizing a plurality of light emitting diodes as light sources, each light emitting diode including a lens portion whose function is divided into direct light area and reflected light area in order to facilitate control of luminous distribution, which enables the luminous distribution control with a reflective mirror arranged around the light emitting diode so as to eliminate need of providing the lens steps.

2. Description of the Related Art

Among a number of light emitting elements, light emitting diodes which have undergone steady luminous flux enhancement are now used in various display units as it is advantageous to use such light emitting diodes in view of increasing the life and power-saving and decreasing the calorific value in comparison with conventional light sources such as incandescent bulbs. With respect to application of light emitting diodes to vehicle lamps, for example, there may be enumerated high mounted stop lamps, side marker lamps and tail stop lamps for preventing motoring accidents caused by rear-end collisions.

More specifically, a light emitting diode has a semiconductor chip (light emitting chip) inside and the chip is protected by a transparent resin-made lens portion. Further, the front end portion of the lens portion has a spherical surface that is rotationally symmetric around the optical axis. Consequently, luminous intensity distribution of a single element is substantially close to the frustrum of a circular cone, whereby the tendency is for the luminous intensity to become high in the central portion near the optical axis on one hand and for the luminous intensity to become lower as the distance between the optical axis and the peripheral portion increases on the other.

As luminous distribution is designed by utilizing only the direct light of a light emitting diode in a lighting device using a conventional light emitting diode, it is needed to use lens steps (fish-eye lens steps) for the light control. In other words, there exist problems arising from difficulty in fully utilizing light contributing to desired luminous distribution unless some lens element is provided in front of the light emitting diode and from a limitation in designing the external appearance due to the formation of the lens steps.

Further, it is important whether the configuration of the lens portion of the light emitting diode is symmetric around the optical axis. In other words, the following inconvenience is caused by making the configuration of the front end of the lens portion rotationally symmetric (a rotator such as a spherical surface) in the conventional LED.

FIG. 14 is a conceptual isoluminous intensity distribution map in the conventional LED, showing a concentric circular pattern arrangement (i.e., isoluminous intensity curves form substantially concentric circles) due to the lens portion in the form of a rotator. Therefore, assuming that a long-sideways range (see a range R indicated by a rectangular frame of a chain line in FIG. 13) with the width in the lateral direction (see H—H line) being greater than the width in the vertical direction (see V—V line), for example, useless light is generated in the upper and lower portions and this causes loss of light that is unrelated to the luminous distribution standard. The light is due to the contribution made only by direct light from the chip of the LED. Accordingly, in order to utilize light without waste, the lens steps (fish-eye lens steps) disposed in front of the LED plays an important part in controlling luminous distribution in the conventional arrangement. However, the problem is that the provision of such lens steps is disadvantageous in view of cost-saving and any restriction imposed on design-making.

Moreover, when a light emitting diode is used as a light source for a lighting device, there are known methods including: utilizing the light directly emitted from the light emitting diode as irradiation light; and providing a reflective mirror around the light emitting diode whereby to utilize not only the light reflected from the reflective mirror but also the light directly emitted from the light emitting diode. In the case of the latter, a reflective mirror having a paraboloid of revolution is employed.

However, use of only the reflective mirror having the paraboloid of revolution is unable to fully satisfy the luminous distribution required for a vehicle lamp and in order to meet such a requirement, light is needed to be diffused from right to left by the function of lens steps.

In other words, a light emitting diode generally has a semiconductor chip (light emitting chip) inside and the chip is protected by a transparent resin-made lens portion (sealing lens). Further, the front end portion of the lens portion has a spherical surface which is rotationally symmetric around the optical axis of the lens portion. Consequently, luminous intensity distribution of a single element is substantially close to the frustrum of a circular cone, whereby the tendency is for the luminous intensity to become high in the central portion near the optical axis on one hand and for the luminous intensity to become low as the distance between the optical axis and the peripheral portion increases on the other.

However, there exist problems such as an increase in cost due to the processing cost for the formation of the lens steps as described above, loss in the quantity of light by passing through the lens steps, and a limitation in designing the external appearance due to the formation of the lens steps.

SUMMARY OF THE INVENTION

An object of the present invention is to obtain a desired luminous distribution without the help of the function of any optical element other than direct emission and reflection by utilizing the light emitted from a light emitting diode with efficiency.

In order to solve the foregoing problems, a light emitting diode having a light emitting chip and a lens portion for containing the chip of which lens portion has the divided areas such as a direct light area for use in directly emitting the light emitted from a chip outside as direct light and a reflected light area for use in emitting the light emitted from the chip and passed through the lens portion toward a reflective member provided outside the lens portion.

Further, the front end portion of the lens portion is used as a direct light area and the area is formed so that it has a configuration irrotationally symmetric around the optical axis of an element, and the peripheral portion of the direct light area or the side portion of the lens portion is used as the reflected light area and the area is formed so that it has a configuration rotationally symmetric around the element.

In a vehicle lamp according to the invention, a plurality of light emitting diodes thus structured are arranged so as to form a group of light sources on a support member and reflective mirrors are disposed in a manner surrounding the respective light emitting diodes. The light emitted from the chip of the light emitting diode is passed through the direct light area before being directly emitted outside and the light emitted from the chip and passed through the reflected light area is emitted toward the reflective mirror disposed with respect to the light emitting diode and reflected therefrom.

With respect to control of light from the light emitting diode according to the invention, the light directly emitted outside the lens portion through the direct light area is differentiated from the light reflected from the reflective member (or reflective mirror) through the reflected light area, so that each ray of light can be utilized effectively on an objective basis regarding contribution to luminous distribution accordingly.

Another object of the present invention is to utilize the light emitted from a light emitting diode with efficiency without the help of the function of any optical element other than direct emission and reflection in a vehicle lamp using a light emitting diode.

In order to solve the foregoing problems, the following arrangement is taken into consideration.

As to the light emitted from a light emitting diode, the light reflected at a position close to the peripheral edge of the opening of the reflective mirror annexed to the light emitting diode is emitted in a direction substantially parallel to the optical axis of the reflective mirror.

On the other hand, the very light reflected at a reflecting point closer to the optical axis of the reflective mirror has an increased angle with the optical axis and is emitted in a direction crossing a plane (including the optical axis) intersecting a plane including the reflecting point and the optical axis at right angles.

Consequently, according to the invention, luminous distribution required for a vehicle lamp can be acquired due to the optical function of the reflective mirror affixed to the light emitting diode without necessitating the refracting function of lens steps.

DESCRIPTION OF THE PREFERRED EMBODIMENTS

Figure 1:
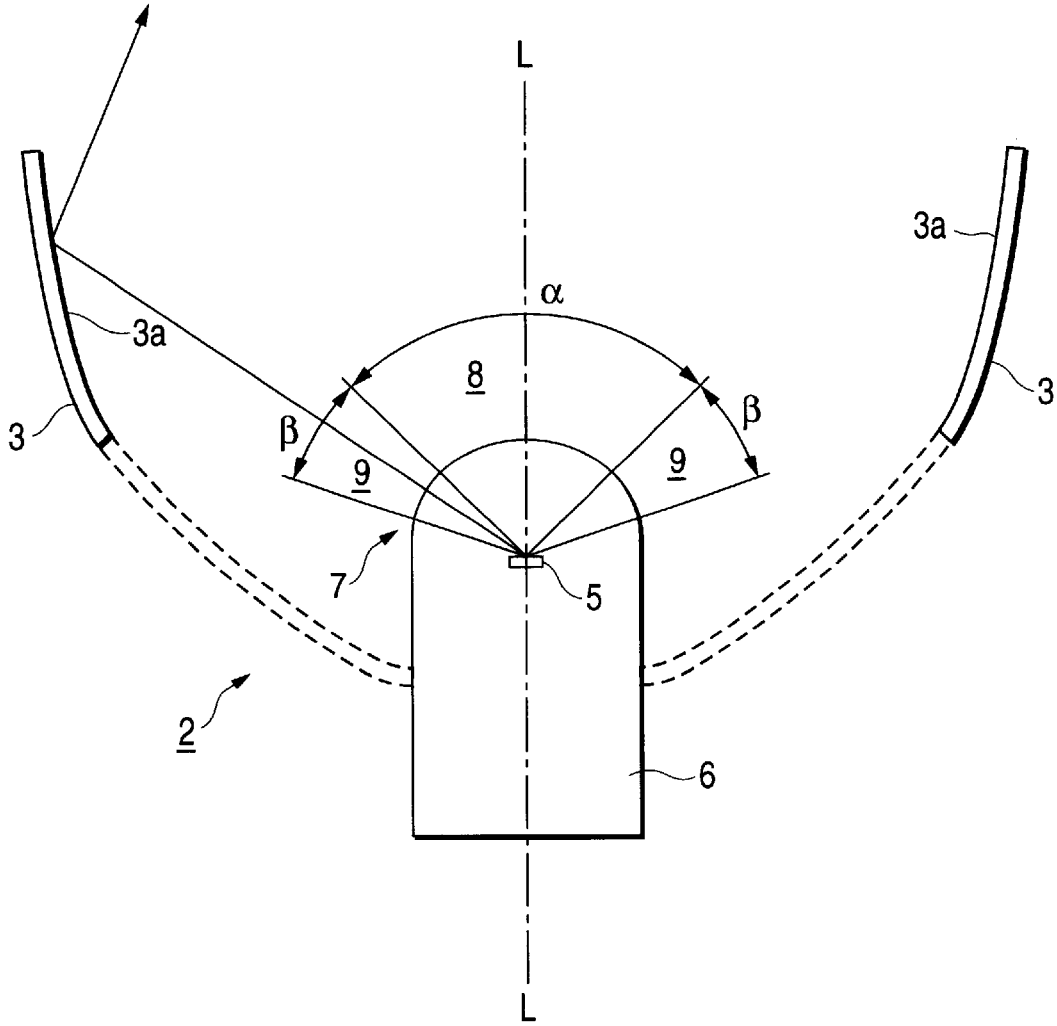
FIG. 1 shows a diagram illustrating the basic formation of a light emitting diode according to the invention.

FIG. 1 is a diagram illustrating the basic structure of a light emitting diode according to the invention.

FIG. 1 is a diagram illustrating the formation of an LED by way of example, wherein an LED 2 comprises a light emitting (semiconductor) chip 5 and a lens portion (or a sealed lens) 6 containing the chip.

The lens portion 6 is formed of transparent colorless or colored resin material and as shown in FIG. 1 a portion 7 ahead of the emission plane of the chip 5 is divided into two areas as indicated below by reference numerals, respectively having different functions.

Direct light area 8 reflected light areas 9

The L—L line in FIG. 1 refers to the optical axis of an LED element which conforms to the optical axis of the reflective mirror 3.

The direct light area 8 covers a predetermined angle $\alpha$ range in a position close to the optical axis. This area is an area for directly emitting the light emitted from the chip 5 out of the lens portion 6 and irradiating the outside as direct light (not the light reflected from the outside of the element).

On the other hand, the reflected light area 9 covers each predetermined angle $\beta$ range adjacent to the peripheral portion of the direct light area 8 or is so regulated as to cover each range over the side portion of the lens portion 6. This reflected light area 9 is needed to emit the light emitted from the chip 5 toward the reflective mirror 3 provided on the outside of the element after the light is passed through the lens portion 6. In other words, the light emitted out of the lens portion 6 through the reflected light area 9 is reflected from the reflective surface 3*a* formed on the reflective mirror 3 once and then emitted forward (in the direction of the emission of light from the lighting device).

In case where the lens portion of the LED has a simple rotationally symmetric configuration, light is needed to be utilized as effectively as possible by making full use of the optical function of the lens steps so as to correct light of no use in this condition with the refracting function of the lens steps. However, there develop problems arising from harmful effect resulting from loss of light even when the light is passed through the lens steps, cost for forming the lens steps and the restrictions imposed on designing because an outer lens without the lens steps is formed thereon (the inside of a lighting device is not seen therethrough).

In order to avoid inconvenience as stated above, the front end portion of the lens portion of the LED is used as the direct light area and the configuration of the area is formed in a manner irrotationally symmetric around the optical axis of the LED element. Assuming that a plane crosses the optical axis of the LED element at right angles with respect to the long-sideways range R of FIG. 14, for example, the configuration of the direct light area as seen from a direction along the optical axis may be so designed that the direct light area is not circular and that width along one of the axes (a first axis) corresponding to the lateral direction is greater than width along the other axis (a second axis) corresponding to the vertical direction (such as an ellipse with the first axis as a major axis and with the second axis as a minor axis and a polygon that is long in the first axial direction with the corners rounded off.

With respect to the reflected light area 9 including the peripheral portion of the direct light area 8 or the side portion of the lens portion, such a reflected light area may preferably have a rotationally symmetric configuration around the optical axis of the LED element (in such as a cylindrical and a conical form). The reason for this is that the lens portion is readily made and light control on the reflective mirror becomes less complicated.

Although there are methods of forming both of the direct light area 8 and the reflected light area 9 with the same resin material and of forming both of them with materials different in optical characteristics, the former is preferred in view of cost saving and easiness of making. Moreover, there are also methods of dividing both of the areas into divided areas such that a difference in level therebetween is visually clear and of forming both of the areas continuously without any difference in level. In this case, the latter is preferred by taking into consideration the appearance of the lens portion and the optical effect.

Figure 2:
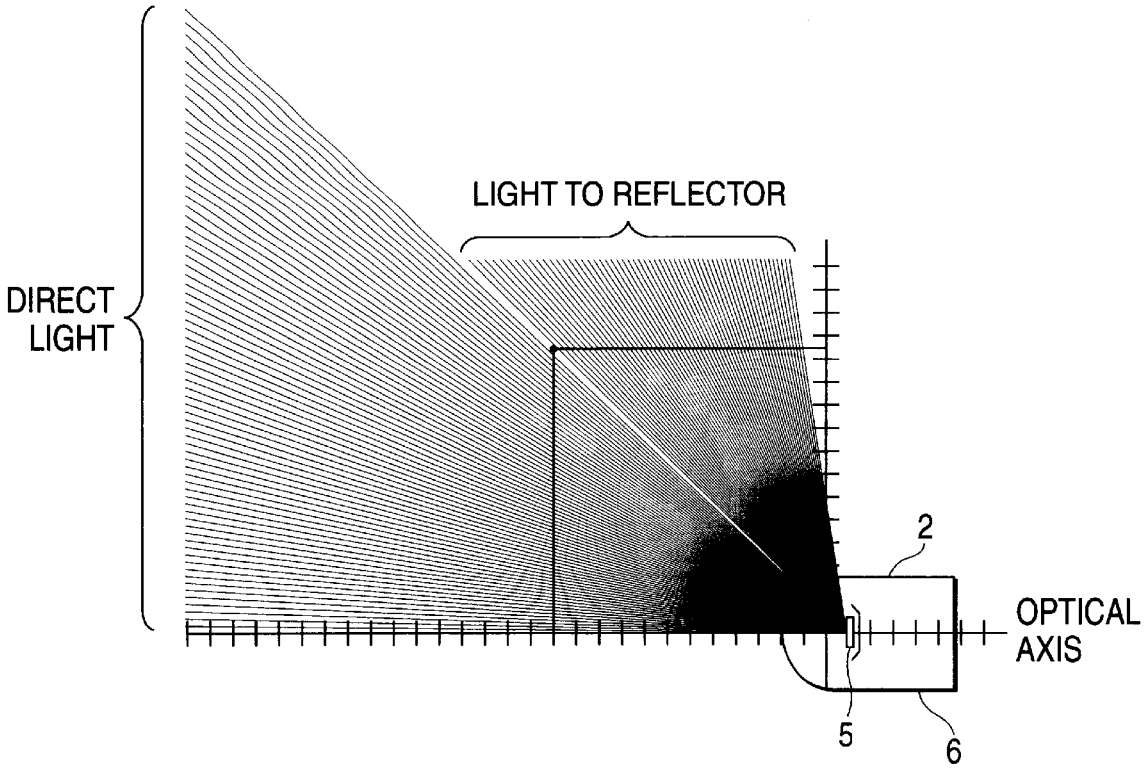
FIG. 2 shows a diagram illustrating light emitted from LED.

In order to form a lighting device using these LEDs, a group of light sources are formed by disposing a plurality of LEDs, in which each LED, being such a LED 2 as described in this invention, is surrounded by the respective reflective mirror. A lens portion 6 of each LED has a direct light area 8 and a reflected light area 9 and as shown in FIG. 2, for example, the light emitted from the chip 5 of the LED 2 is directly emitted outside via the direct light area 8, whereas the light passed through the direct light area 9 after being emitted from the chip 5 is emitted toward the reflected light area disposed with respect to the LED 2 before being reflected therefrom.

Figure 3:
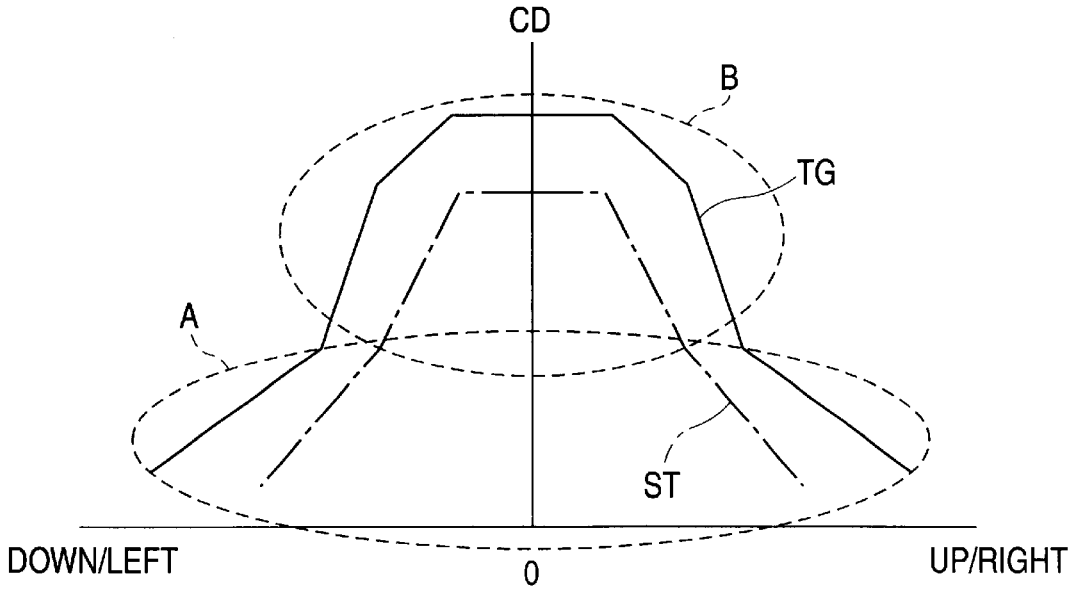
FIG. 3 shows a diagram showing the target luminous distribution and luminous distribution standard of a vehicle lamp.
Figure 4:
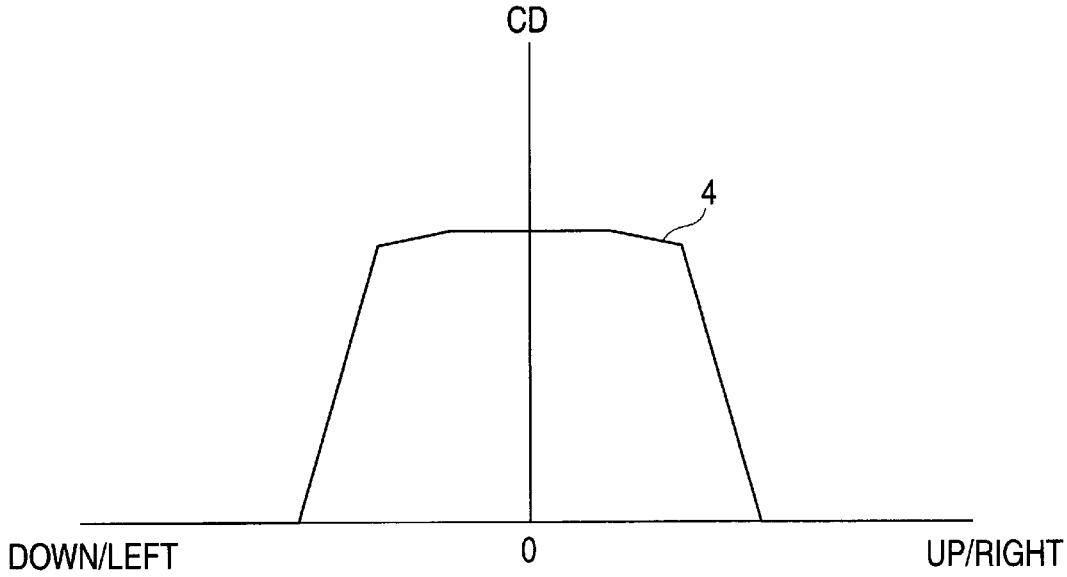
FIG. 4 shows a diagram showing target luminous distribution by the reflective mirror.

FIGS. 3 and 4 are diagrams illustrating an example of designing luminous distribution.

FIG. 3 shows a comparison of the luminous intensity distribution (design target) and the luminous distribution standard of the vehicle lamp by way of example, wherein the horizontal axis represents irradiance positions (irradiance angles) in the vertical or lateral direction concerned in the luminous distribution pattern (the right direction of the axis shows UP or RIGHT, whereas the left direction of the axis shows the reverse direction, that is, DOWN or LEFT) and wherein a luminous intensity axis CD as the vertical axis represents the characteristics. A graphic line TG shown by a solid line in FIG. 2 indicates characteristics of target luminous distribution, whereas a graphic line ST shown therein by a chain line indicates standardized characteristics. In this case, the graphic line ST has a substantially trapezoidal central crest portion and a skirt portion slightly broaden toward the right and left ends, whereas the graphic line TG has a contour similar to and positioned outside the graphic line TS so as to contain the graphic line TS (however, both portions closed to the crest portion are angular). Moreover, both of the graphic lines are symmetrical with respect to the luminous intensity axis CD.

A portion surrounded with a round frame A in FIG. 3 is obtained as the contribution of direct light given by the LED 2 and a portion surrounded with an upper round frame B is obtained as the contribution of reflected light given by the LED 2 and the reflective mirror 3. As seen from FIG. 2, the reflected light mainly contributes to the central portion having high luminous intensity, whereas the direct light contributes to the skirt portion.

FIG. 4 shows luminous intensity distribution (a design target) as to reflected light with the setting of the vertical and horizontal axes as in the case of FIG. 3.

A shown by a graphic line 4, luminous distribution characteristics are substantially in a trapezoidal form having a narrow diffusion angle in comparison with the contribution range (skirt portion in FIG. 3) of direct light. The configuration of a reflective surface 3*a* is finally determined by carrying out simulation including tracking of rays of light so as to obtain distribution close to the characteristics.

As set forth above, a desired luminous distribution can be obtained by efficiently combining the direct light emitted from the LED and the light reflected from the reflective member.

Moreover, a see-through lens member without any lens step formed therein or a lens member having almost no function of a lens is formable as the outermost member in the lighting device. In other words, since it is possible to arrange the lens member in front of the LED and the reflective mirror and to cause the direct light emitted from the LED and the light reflected from the reflective mirror to be emitted outside the lighting device via the lens portion, the influence of light reduction at the lens steps is obviated (e.g., it is advantageous in view of cost saving that the use of a smaller number of LEDs suffices for the purpose) and no restrictions are imposed on design-making (the inside of the lighting device is in a see-through condition from the outside).

[Embodiment]

FIGS. 5 to 12 show an embodiment of the invention applied to an automotive lamp (tail stop lamp) by way of example.

Figure 5:
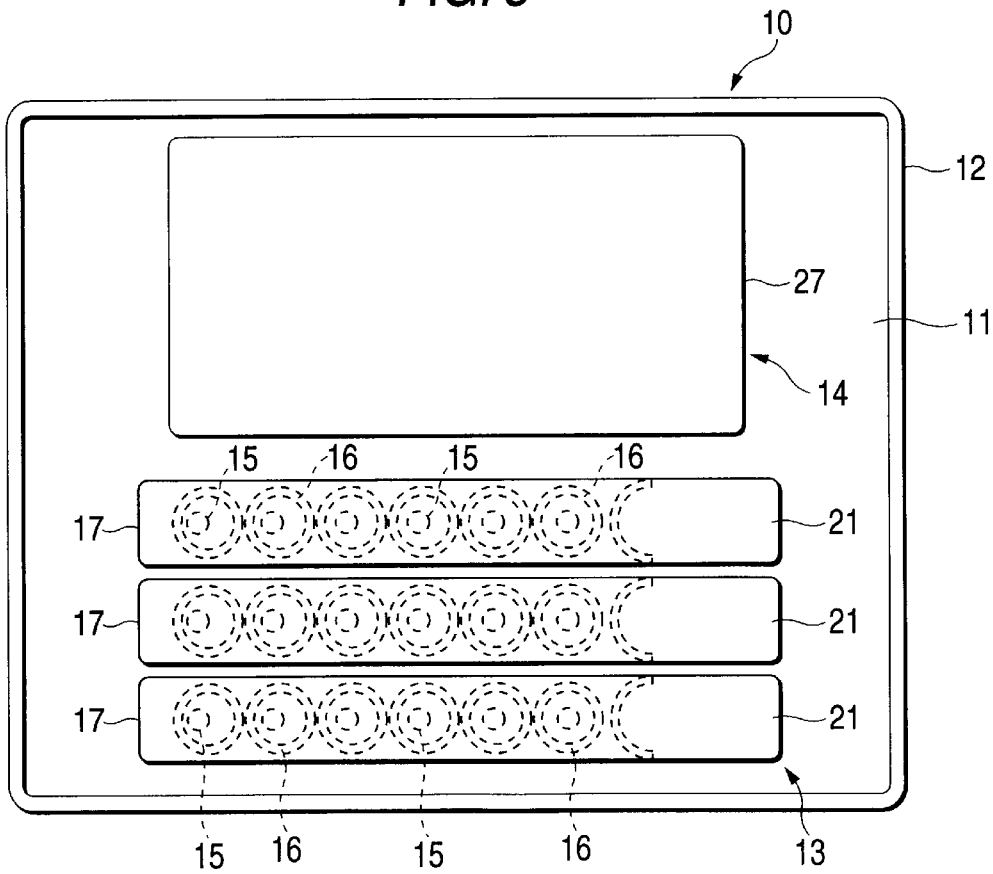
FIG. 5 shows a schematic elevational view of a lighting device according to an embodiment of the invention together with FIGS. 6 to 12.

FIG. 5 is a schematic elevational view of a lighting device 10, wherein a first lamp portion 13 and a second lamp portion 14 are disposed in the space partitioned with a lens member 11 formed of transparent material (synthetic resin or glass) and a lamp body 12 of the lighting device.

The first lamp portion 13 functions as a stop lamp, for example, and has a group of light sources using a number of LEDs 15, 15, . . . and reflective mirrors 16, 16, . . . provided for the respective LEDs (though the LEDs and the reflective mirrors are shown by broken lines for convenience's sake, these can be visually recognized in a see-through condition of the lens member 11. In this example of the invention, however, there are arranged irradiance portions 17, 17, 17 lined three deep along the vertical direction, each irradiance portion 17 being constituted of six light source units, each of which is formed with the LED 15 and the reflective mirror 16.

Figure 6:
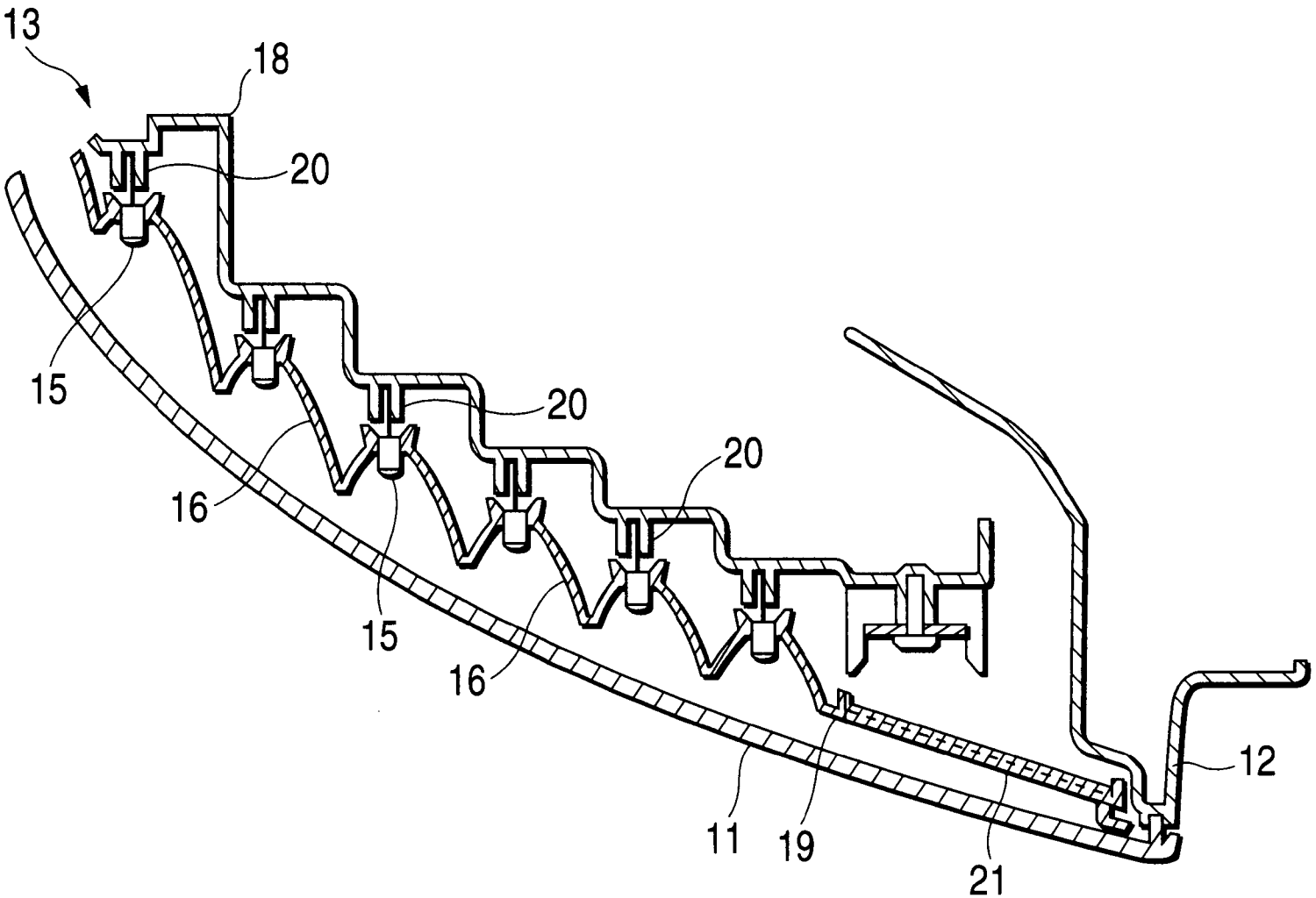
FIG. 6 shows a horizontal sectional view of the principal part.
Figure 7:
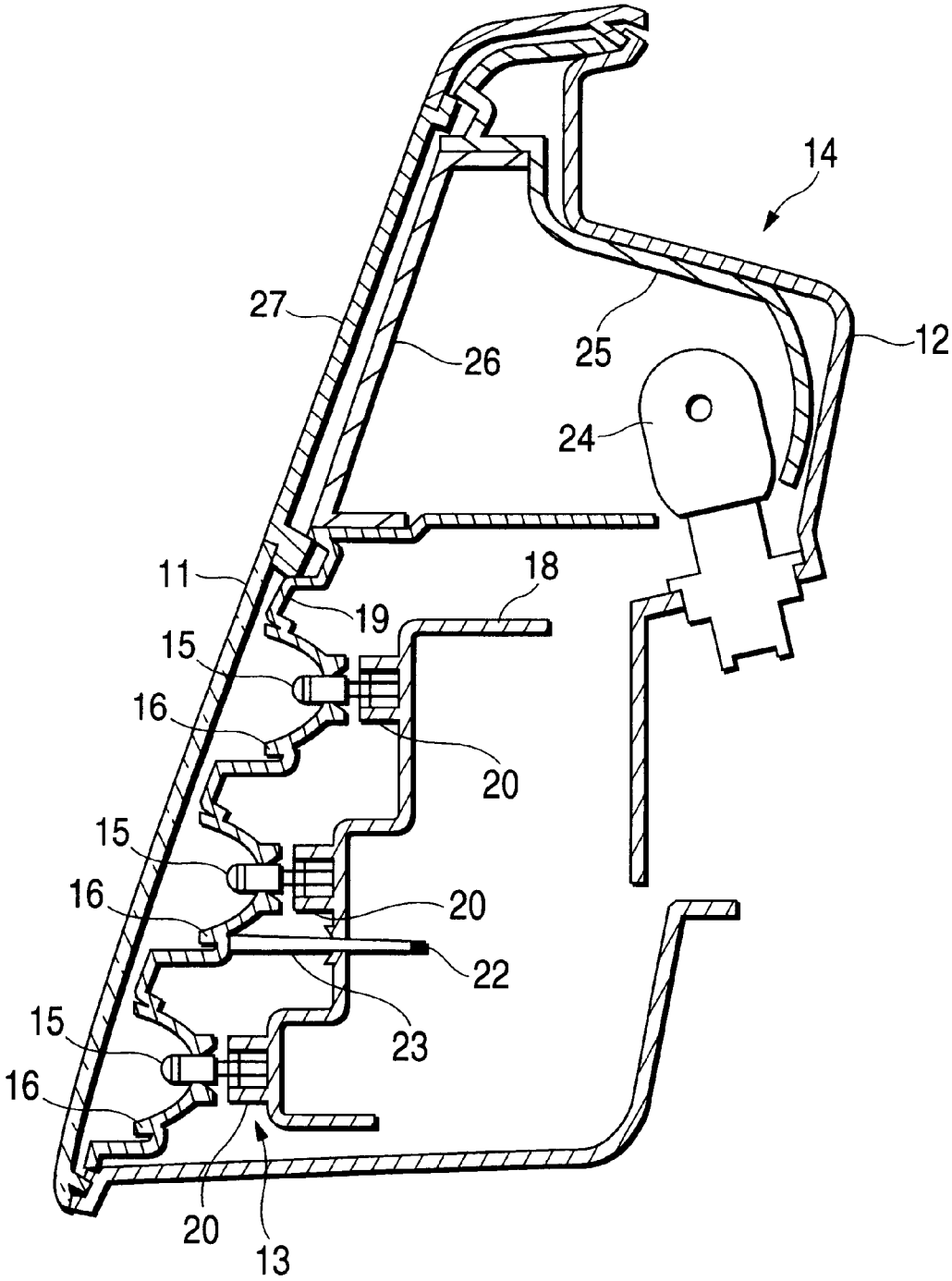
FIG. 7 shows a vertical sectional view of the principal part.

FIG. 6 is a sectional view of the first lamp portion 13 with a lighting device 10 being cut in its longitudinal (horizontal direction) and FIG. 7 a sectional view thereof with the lighting device being cut in a direction (vertical direction) perpendicular to the horizontal direction.

As shown in the drawings above, the first lamp portion 13 includes a support member (base member) 18 formed stepwise by using synthetic material and a reflector member 19 for supporting the lens portion of each LED 15 with the reflective mirror 16 formed around the LED.

Further, holders 20, 20, . . . for disposing the LEDs on the flat places are provided in the respective step portions of the support member 18 and the lead (outer lead) of the LED 15 is fitted in each holder, whereby the holder is electrically connected to a wiring member (not shown).

The reflective mirrors 16, 16, . . . are provided to the reflector member 19 and the lens portion of each LED is inserted through a light-source placing hole formed in the central portion of each reflective mirror. Further, a reflective surface (having a rotational symmetric configuration around the optical axis) is formed by aluminum deposition on each reflective mirror and functions as what causes the light emitted from the lens portion of the LED 15 to be reflected in the irradiance direction of the lighting device 10.

Members 21, 21, 21 (see FIGS. 5 and 6) provided in a position adjacent to the reflector member 9 are recursive reflective plates.

When the reflector member 19 is positioned properly with respect to the support member 18, a positioning portion 22 projected from the reflector member 19 toward the support member 18 is inserted into the support hole 23 of the support member 18 whereby to mate the reflector member and the support member together so that both of them can be put in position.

Further, a portion forming the first lamp portion 13 out of the lens member 11, that is, an interior area corresponding to the LEDs 15 and the reflective mirrors 16 has no lens steps but is in a see-through condition from the outside. Thus, the lens portion of each LED 15 and the surface of the reflector member 19 can be seen directly from the outside of the lighting device.

As shown in FIG. 7, the second lamp portion 14 includes an incandescent lamp 24 as a light source, a reflective mirror 25 and an inner lens 26 and functions as a turn signal lamp, for example. A lens 27 formed with a number of lens steps (not shown) is provided in a portion corresponding to the lamp portion 14 out of the lens member 11, the lens being disposed on the outer side of the inner lens 26.

FIGS. 8 to 11 show the constitution of an LED element by way of example.

The LED 15 has a lens portion 28 formed of sealing resin such as epoxy resin and two leads 29 and 29. Of these leads, the portion covered with the sealing resin corresponds to an inner lead 29*a,* whereas the portion projected outside corresponds to an outer lead 29*b*. Further, a chip (not shown) is disposed in a recessed portion formed in the inner lead on the cathode side and the chip is connected to the inner lead on the anode side by wire bonding.

Figure 9:
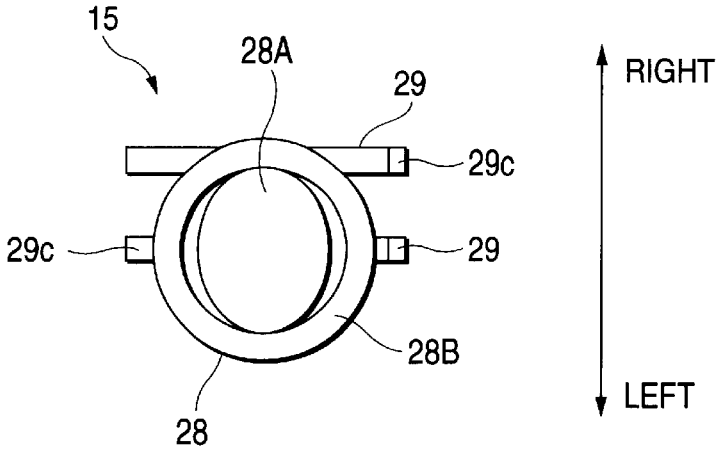
FIG. 9 shows a elevational view of LED.

The front end portion 28A of the lens portion 28 is used as the direct light area and as shown in FIG. 9 the configuration seen from the optical axis direction of the element is elliptic. According to this example of the invention, the major axis of the ellipse corresponds to the lateral direction of the lighting device 10, whereas the minor axis of the ellipse corresponds to the vertical direction of the lighting device. When the LED 15 is mounted on the holder 20, the predetermined positional relation is made available.

Figure 10:
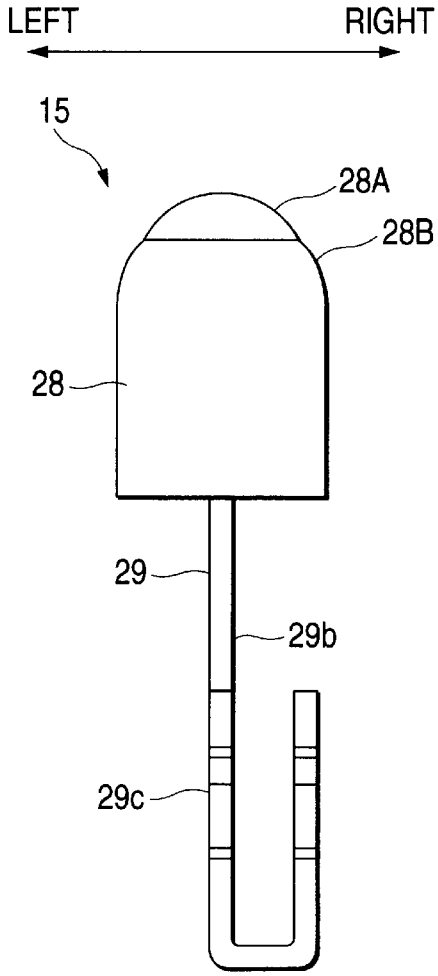
FIG. 10 shows a side view as seen from an angle different from FIG. 8.

With respect to the direct light area, the cross sectional configuration view on the plane, which includes the axis extended in the vertical direction (of the lighting device) and the optical axis, is elliptic as shown in FIG. 9. Moreover the cross sectional configuration on the plane, which includes the axis extended in the lateral direction (of the lighting device) and the optical axis, is circular (a constant curvature) as shown in FIG. 10. The focal point of the ellipse and the central position of the circle are set in position in front of the chip according to the positional relation to the chip in the lens portion.

In the lens portion 28, an area 28B adjacent to the periphery of the direct light area 28A is used as a reflected light area and according to this example, is circular in form as seen from the optical axis of the element. Further, the cross sectional configuration on the plane including the axis extended in the vertical or lateral direction (of the lighting device) is circular (a constant curvature) as shown in FIG. 9 and is rationally symmetric around the optical axis. The light emitted from the chip of the LED and passed through the reflected light area 28B before being emitted outside the lens portion 28 reaches the reflective surface of the reflective mirror 16 and is reflected therefrom.

In the lens portion 28, though a portion excluding the areas above has a cylindrical external configuration, the portion is irrelevant to the optical function with respect to light from the chip. According to this example, moreover, though there exists a difference in level between the direct light area 28A and the reflected light area 28B, both the areas may be so designed as to be continuously connected together on the outer surface of the lens portion 28.

Figure 11:
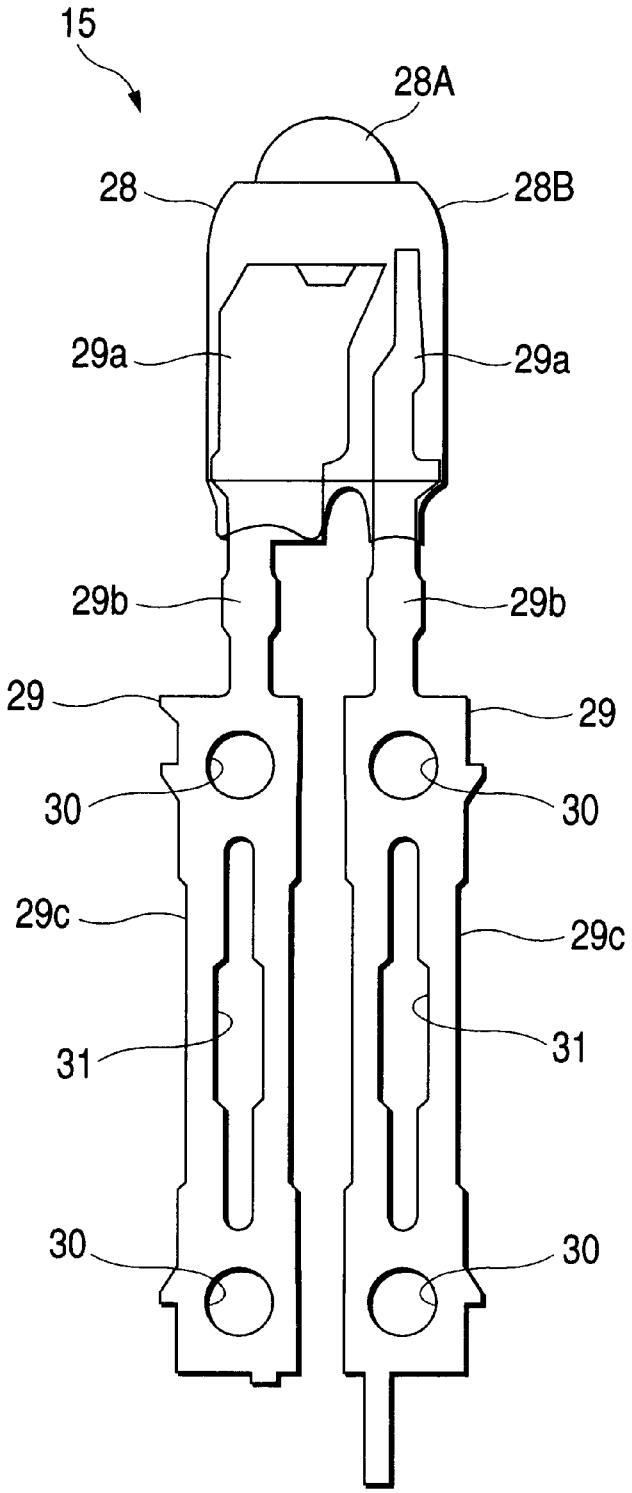
FIG. 11 shows a side view of an outer lead before the outer lead is subjected to bending process.

The outer lead 29*b* of the LED element is formed by using a conductive material (e.g., copper alloy) having an appropriate elasticity and high thermal conductivity and a wide portion 29*c* is formed on a lead basis as shown in FIG. 11. A pair of circular holes 30 and 30 are bored in a position dose to each longitudinal end of the wide portion and slits longitudinally extended are formed therebetween.

Figure 8:
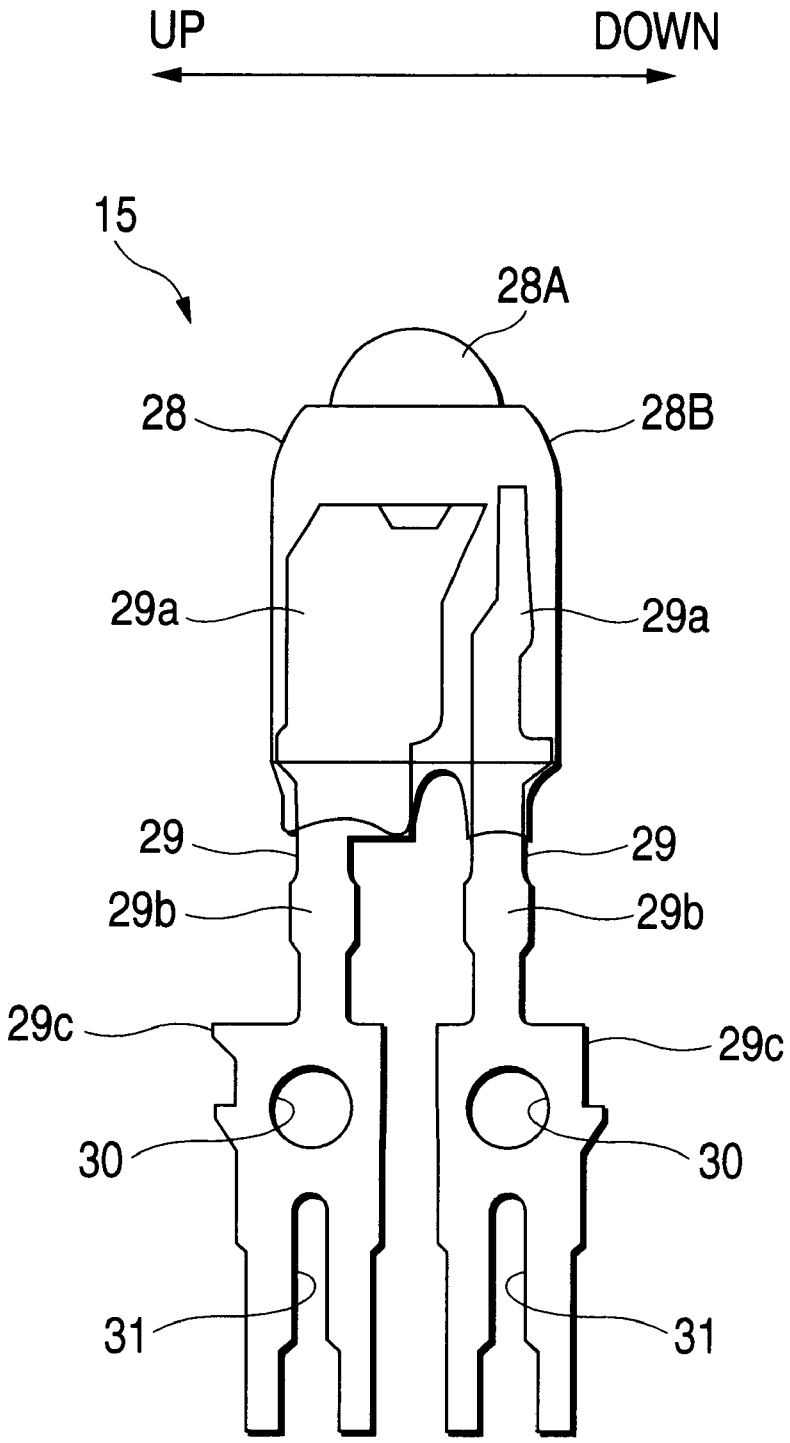
FIG. 8 shows a side view of an LED by way of example together with FIGS. 9 to 11.

As shown in FIGS. 8 to 10, the slits 31 are formed by bending each outer lead 29*b* into a U-shape in the center of the wide portion 29*c* of the outer lead, so that electrical connections are set up and the leads are mechanically fixed by press-fitting a wiring material (not shown) into the slits. Moreover, the circular holes 30 function as guide holes for preventing the outer leads 29*b* from positional deviation while the circular holes are being bent.

Figure 12:
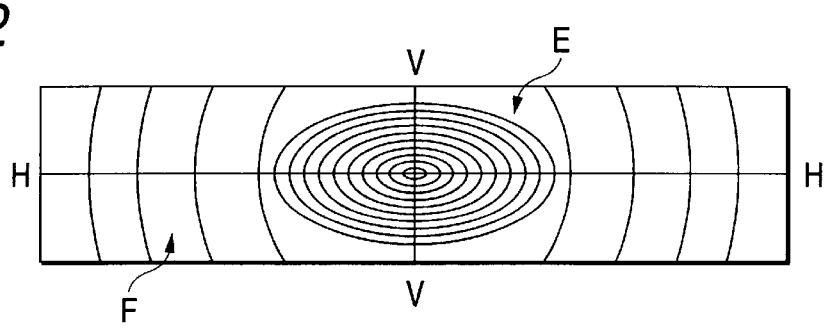
FIG. 12 shows a diagram illustrating luminous distribution of the lighting device.

FIG. 12 shows isoluminous intensity distribution in the lighting device 10, wherein the configuration and trend of the isoluminous intensity curves are shown by taking an axis H—H in the lateral direction (or horizontal direction) as the horizontal axis and taking an axis V—V in the vertical direction as the vertical axis (see FIGS. 3 and 4 for the target design and the standard of luminous intensity distribution).

The isolux curves that are long sideways and substantially elliptic and contribute to luminous intensity distribution near the central portion are concentrated in the central portion and this portion E shows contribution to luminous distribution mainly by the direct light of the LED 15. Moreover, the low-density portion F of the isolux curves around the portion E shows contribution to luminous distribution by the reflected light emitted from the LED 15 via the reflective mirror 16.

Figure 14:
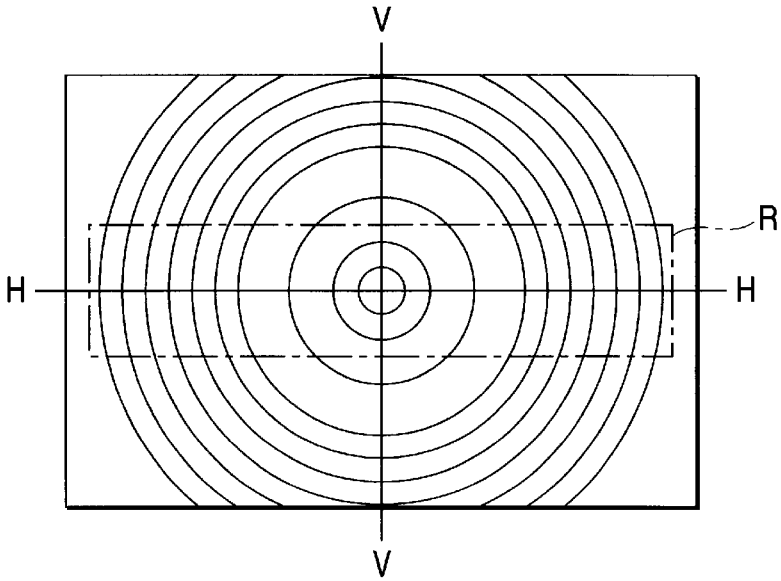
FIG. 14 shows a diagram illustrating problems in the prior art.

In comparison with the example of FIG. 14, as useless light decreases in the vertical direction, light utilization efficiency is proved to be prominent. As set forth above, the configuration of the direct light area 28A in the lens portion 28 is laterally long elliptic as seen from the direction of the optical axis of the element and the range that the direct light bears in the luminous intensity distribution shows laterally long-sideways distribution in harmony with the luminous distribution standard. Further, the configuration of the reflected light area 28B in the lens portion 28 is made rotative around the optical axis. As the reflective mirror 16 is rationally symmetric around the optical axis, the range that the reflected light bears shows concentric circular distribution as before. In this case, the configurations of the direct light area 28A and the reflected light area 28B are obtained as a result of which the functions of the respective areas are separated from each other and design of luminous distribution as well as their simulation is carried out.

Figure 13:
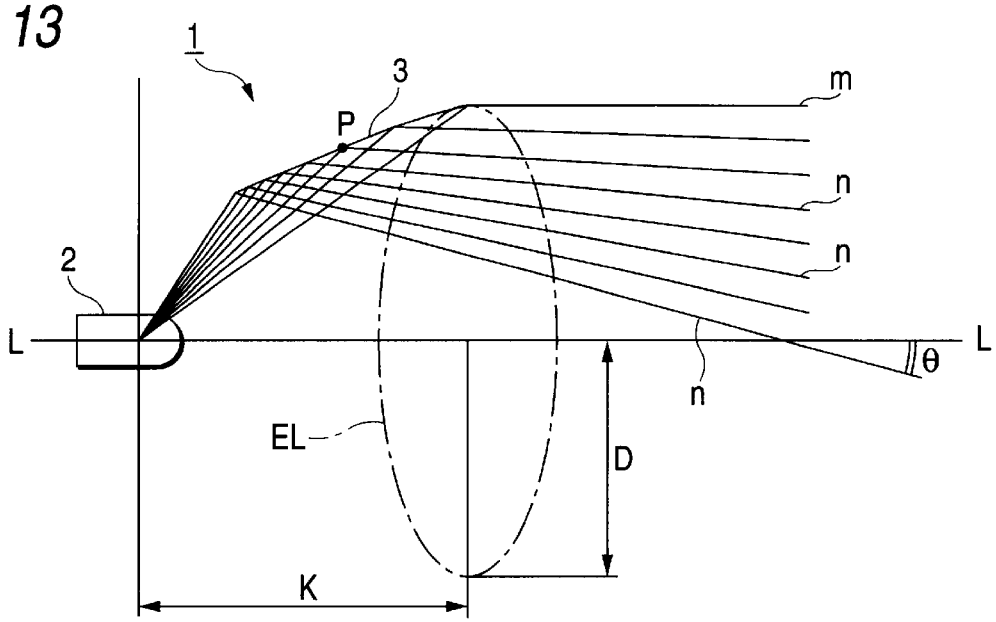
FIG. 13 shows a diagram illustrating the characteristics of a reflective mirror according to the invention.

FIG. 13 is a diagram illustrating a configuration of the principal part of a lighting device according to the invention.

In a lighting device 1, a light emitting diode (hereinafter called 'LED') 2 is used as a light source and a reflective mirror 3 is provided around (or within a predetermined range in the direction of light emission). In FIG. 1, only part of the configuration (curved line) formed by cutting the reflective mirror 3 across a plane including the optical axis L—L is shown. Moreover, an ellipse EL shown by a chain line in FIG. 13 conceptually indicates the opening of the reflective mirror 3 (but actually invisible from a sideward direction) with a radius D representing the opening radius.

The configuration of the reflective surface of the reflective mirror 3 according to the invention is characterized by the followings.

As to the rays of light emitted from the LED 2, the rays of light reflected at positions close to the peripheral edge of the opening of the reflective mirror 3 are emitted in substantially parallel to the optical axis of the reflective mirror.

On the other hand, the rays of light reflected at reflecting points (see rays of light n, n, . . . in FIG. 13) closer to the optical axis of the reflective mirror are caused to sequentially have greater angles (diffusion angles shown by θ in FIG. 13) with the optical axis and are emitted across a plane (which includes the optical axis L—L and is perpendicular to the drawing) perpendicular to a plane including the reflecting points and the optical axis.

In other words, the ray of light reflected near the opening of the reflective mirror 3 is directed forward in parallel to the optical axis L—L at an angle of $\theta=0$ or $\theta\approx0$, and with respect to the ray of light reflected at a reflecting point P, the greater the value of θ grows, the closer the reflecting point P becomes situated to the optical axis L—L (the value of the angle θ becomes small at a reflecting point away from the position of the light source and the value of the angle θ gradually grows greater as the distance between the reflecting point and the light source decreases).

The reason why it is effective for the configuration of the reflective surface to have such a reflection tendency is related to the luminous distribution required for a vehicle lamp and the relation therebetween will be described below in detail.

As shown by a graphic line 4 in FIG. 4, there are indicated substantially trapezoidal luminous distribution characteristics with a narrow diffusion angle in comparison with the contribution range (skirt portion in FIG. 3) of direct light.

In order to satisfy the luminous distribution standard and to control light with great efficiency by combining the direct light directly emitted and utilized and the light utilized after being reflected from the reflective mirror once out of the rays of light emitted from the LED, it is preferred to make an arrangement to form the base portion of FIG. 3 with the direct light and to form the upper portion (central portion) thereof with the reflected light.

Incidentally, the rays of light emitted from the LED are characterized in that their luminous intensity is generally lowered as the emission angle increases, whereby the luminous intensity distribution of a single LED is high in its central portion (in the vicinity of the optical axis) and is lowered toward its periphery.

On the other hand, the luminous distribution characteristics due to the reflective mirror are such that as shown in FIG. 4 a substantially constant range in which the luminous intensity is high exists in the central portion near the optical axis and that the luminous intensity tends to suddenly decline outside that range. Therefore, of the light reflected from the reflective mirror, the very light emitted from the LED at narrow angles (light near the optical axis L—L and what has small angles of incidence on the reflective mirror) is caused to be reflected in a direction substantially parallel to the optical axis L—L so that the light is emitted in the frontal direction of the lighting device (thus contributing to the luminous intensity of the central portion). Further, light contributing to the peripheral portion (tilted portion) of the graphic line 4 of FIG. 4 is made obtainable by gradually increasing the diffusion angle so that the reflected light is directed to the inside (the side directed to the optical axis L—L) of the reflective mirror as the emission angle increases. In other words, a reflective surface suitable for targeted luminous distribution is fulfilled by the configurative characteristics. This is due to the fact that the LED has directivity and makes unobtainable light radiating in all directions as in the case of an incandescent bulb and particularly makes unutilizable light from the side of the lens portion, which provides some background to this problem.

With respect to the three-dimensional configuration of the reflective mirror, there are methods of forming a rotator by turning the cross section shown by the curved line in FIG. 13 round the optical axis L—L and of forming a surface contour irrotationally symmetric round the optical axis; however, the former is preferred as it is easy to form.

In the application of the invention to a vehicle lamp, an arrangement is made to form a group of light sources by disposing a plurality of LEDs and to surround the individual LED with a reflective mirror, the lens portion of each LED being divided into a direct light area and a reflected light area. In other words, with respect to controlling light from the LED, it is desirous to effectively utilize each ray of light on an objective basis concerning contribution to luminous distribution by distinguishing the light directly emitted outside the lens portion through the direct light area from the light reflected from the external reflective mirror through the reflected light area.

Of the light emitted from the chip 5 of the LED of FIG. 1, the light passed through the direct light area 8 and the light passed through the reflected light area 9 after being emitted from the chip is emitted toward the reflective mirror 3 disposed with respect to the LED before being reflected therefrom, whereby the luminous distribution shown in FIGS. 3 and 4 is obtainable by combining the direct light and the reflected light efficiently according to their functions.

Thus, a see-through lens member without any lens step being formed or a lens member having substantially no lens function is usable as the outermost member in the lighting device. More specifically, as it is possible to arrange the lens member like this over the LED and the reflective mirror so that the direct light from the LED and the light reflected from the reflective mirror are emitted out of the lighting device via the lens member, the effect of light attenuation by the lens steps is obviated (e.g., the advantage in view of cost saving is that the use of a smaller number of LEDs suffices for the purpose) and no restrictions are imposed on designing (the inside of the lighting device is in a see-through condition from the outside). In addition, as the contour of the lighting device 1 sheens in harmony with the peripheral edge of the reflective mirror 3 when the lighting device is turned on, there are corresponding advantages including improving the feel of a material as the contour thereof becomes clear and making the lighting device compact since the distance from the center of light emission of the LED up to the opening (distance between an intersection point at which a plane including the opening edge crosses the optical axis at right angles and the center of light emission of the LED, see K of FIG. 13) with respect the diameter of the opening of the reflective mirror can be shortened.

According to the invention described in claim 1, with respect to control of light from the light emitting diode according to the invention, the light directly emitted outside the lens portion through the direct light area is differentiated from the light reflected from the reflective member (or reflective mirror) through the reflected light area, so that each ray of light can be utilized effectively on an objective basis regarding contribution to luminous distribution. Accordingly, desired luminous distribution is obtainable without necessitating the refracting function of lens steps. Moreover, the harmful effect caused by the fact that the configuration of the lens portion of the light emitting diode is rotationally symmetric around the optical axis can be prevented.

Further, the problems of cost for forming the lens steps and about reduction in the quantity of light are made solvable and the restrictions imposed on designing the external appearance depending on the formation of the lens steps are obviated.

Still further, as luminous distribution necessary for a vehicle lamp can be acquired because of the optical function of the reflective mirror affixed to the light emitting diode without necessitating the refracting function of lens steps, the problems of cost for forming the lens steps and about reduction in the quantity of light are made solvable and the restrictions imposed on designing the external appearance depending on the formation of the lens steps are obviated.

What is claimed is:

1. A vehicle lamp using a light emitting diode as a light source and having a reflective mirror arranged for the light emitting diode, wherein a plurality of light emitting diodes are arranged so as to form a group of light sources, reflective mirrors are disposed in a manner surrounding the respective light emitting diodes, a direct light area and a reflected light area are provided to a lens portion of each light emitting diode, of the light emitted from the chip of the light emitting diode, the light passed through the direct light area is emitted outside the lens portion, and the light emitted from the chip and passed through the reflected light area is emitted toward the reflective mirror disposed with respect to the light emitting diode, in the light emitted toward the reflective mirror, the light reflected at a position close to the peripheral edge of the opening of the reflective mirror is emitted in a direction substantially parallel to an optical axis of the reflective mirror, and in the light emitted toward the reflective mirror, the light reflected at a reflecting point closer to the optical axis of the reflective mirror has an increased angle with the optical axis of the reflective mirror and is emitted in a direction crossing a plane intersecting a plane including the reflecting point and the optical axis of the reflective mirror at right angles.

2. A vehicle lamp using a light emitting diode as claimed in claim 1, wherein:

a front end portion of the lens portion of the light emitting diode is used as the direct light area; the direct light area is formed in a manner irrotationally symmetric around the optical axis of the chip;

one of the peripheral portion of the direct light area and a side portion of the lens portion is used as the reflected light area; and the reflected light area is formed in a manner rotationally symmetric around the optical axis of the chip.

3. A vehicle lamp using a light emitting diode as claimed in claim 1, wherein a see-through lens member without any lens step formed therein or a lens member having almost no refracting function is disposed in front of the light emitting diodes and the reflective mirrors; and the direct light emitted from the light emitting diodes and the light reflected from the reflective mirrors are emitted outside the vehicle lamp via the lens member.

* * * * *